United States Patent [19]

Clark

[11] Patent Number: 4,637,209

[45] Date of Patent: Jan. 20, 1987

[54] FLUID DRIVEN POWER PLANT

[76] Inventor: Garry E. Clark, 801 Pierce Rd., Red Oak, Tex. 75154

[21] Appl. No.: 766,937

[22] Filed: Aug. 19, 1985

Related U.S. Application Data

[63] Continuation-in-part of Ser. No. 514,167, Jul. 15, 1983, Pat. No. 4,541,243, which is a continuation-in-part of Ser. No. 266,933, May 26, 1981, Pat. No. 4,459,084.

[51] Int. Cl.[4] ..... F02B 71/04

[52] U.S. Cl. ..... 60/595; 60/413; 60/660; 417/11; 417/380

[58] Field of Search ..... 60/413, 414, 416, 419, 60/595, 652, 660; 417/11, 38, 340, 364, 380

[56] References Cited

U.S. PATENT DOCUMENTS

| | | | |
|---|---|---|---|
| 1,454,075 | 5/1923 | Powell | 123/197 |
| 2,007,305 | 7/1935 | Pescara | 417/364 |
| 2,134,995 | 11/1938 | Anderson | 123/197 |
| 2,168,829 | 8/1939 | Pescara | 417/364 |
| 3,170,406 | 2/1965 | Robertson | 417/364 |
| 4,111,164 | 9/1978 | Wuerfel | 123/197 |
| 4,115,037 | 9/1978 | Butler | 417/341 |
| 4,229,943 | 10/1980 | Kriegler | 60/652 |
| 4,382,748 | 5/1983 | Vanderlaan | 417/11 |

*Primary Examiner*—Stephen F. Husar
*Attorney, Agent, or Firm*—Jones & Askew

[57] ABSTRACT

A fluid-driven power plant includes a motor and a combustion energy input device combined in a closed, pressurized system. A balanced cylinder provides variable low pressure fluid storage within the system and also operates the compression stroke of the combustion device. A compression acceleration cylinder in direct fluid communication with the accumulator assists in the compression stroke allowing the balance cylinder to be operated at a lower pressure. An opposed combustion piston configuration balances the forces within the system. A device for monitoring the speed of the combustion pistons allows for compensation for misfires and variations in the heating value of fuel. Apparatus is provided to adjust the sensitivity of the power demand controls and to anticipate a future demand for high power output.

22 Claims, 8 Drawing Figures

FLUID DRIVEN POWER PLANT

CROSS REFERENCE TO RELATED APPLICATION

This application is a continuation-in-part of U.S. Ser. No. 514,167, filed July 15, 1983, now U.S. Pat. No. 4,541,243; which is a continuation-in-part of U.S. Ser. No. 266,933, filed May 26, 1981, now U.S. Pat. No. 4,459,084.

TECHNICAL FIELD

The present invention relates to a fluid driven power plant, and more particularly relates to such a power plant which utilizes an internal combustion energy source and maintains a substantially constant system volume under pressure.

BACKGROUND ART

Various fluid pumping systems powered by internal combustion engines have been developed. Examples of such systems are shown in U.S. Pat. Nos. 3,606,591; 3,260,213; 3,995,974; 4,093,405; 4,097,198; and 4,205,638. U.S. Pat. No. 4,459,084 discloses a power system in which a cam driven by a steam piston in turn drives a pair of opposing fluid pistons. The pressurized fluid is stored in a high pressure accumulator and directed through a hydraulic motor when desired into a low pressure accumulator. U.S. Pat. No. 2,334,688 discloses an internal combustion engine in which the output is governed by the length of the stroke of the piston.

U.S. Pat. Nos. 3,751,905; 4,093,405; and 4,115,037; and Ferris, "Toward a Hydraulic Prime Mover," Paper No. 780748, Soc. of Auto. Engineers 1978; show opposed combustion piston arrangements in fluid pumping systems.

Other patents in this field are listed on the patents mentioned above in the cross reference to related applications.

SUMMARY OF THE INVENTION

The present invention represents improvements in the fluid driven power plant of U.S. Pat. No. 4,541,243.

In the system disclosed in U.S. Pat. No. 4,541,243, the balance cylinder alone provides power for the compression stroke. The pressure drop across the motor must be restricted to allow sufficient remaining pressure in the balance cylinder to operate the compression stroke. Thus, a smaller than desired proportion of the energy of the pressurized fluid is used to power the motor. The present improvements provide an additional cylinder in communication with the accumulator for assisting the balance cylinder during the fill stroke. Generally described, this feature of the invention provides a fluid-driven power plant, comprising fluid handling means containing a substantially constant system volume of fluid under pressure, the fluid handling means comprising an output cylinder including an output piston capable of a fill stroke and an output stroke; a balance cylinder in fluid communication with the output cylinder; means for operating the balance cylinder to deliver fluid to the output cylinder during the fill stroke; means for operating the output cylinder to deliver fluid therefrom; an accumulator in fluid communication with the output cylinder the operating pressure level of the accumulator being higher than the pressure within the balance cylinder; a compression acceleration cylinder in fluid communication with the accumulator and including an acceleration piston linked to the output piston; and a fluid-driven motor having a port in fluid communication with the accumulator. The present invention also provides means for measuring the speed of the combustion piston during the combustion stroke. This information can be used to monitor and correct misfires and to regulate the injection of fuel to compensate for differences in the heating value of the fuel. Alternate preferred embodiments are disclosed, one utilizing a magnetic pickup and the other utilizing a radar or sonar device. Generally described, this feature of the invention provides a fluid pumping system, comprising an output cylinder including an output piston; a combustion cylinder including a combustion piston operatively linked to the output piston; the output and combustion pistons being capable of a compression stroke and a power stroke; and means for measuring the speed of the combustion piston during the power stroke.

The present invention also provides an improved combustion cylinder arrangement in which two opposed combustion pistons exert the same force in opposite directions to balance the forces and reduce vibration. The piston assembly is linked to the output piston in the compression cylinder. Generally described, this feature of the invention provides a fluid pumping system, comprising an output cylinder including an output piston; a pair of opposed combustion pistons; cylinder means for confining the opposed combustion pistons for reciprocation along a colinear path; the output and combustion pistons being capable of a compression stroke and a power stroke; and means for drivingly connecting each of the combustion pistons to the output piston including means for transferring the energy of combustion of each of the combustion pistons during each power stroke substantially uniformly to the output piston over the entire length of the power stroke.

The present invention further provides an additional control over the buildup of pressure in the accumulator, which allows the accumulator to be pressurized to the maximum pressure independent of the current demand for power. Such a control allows the operator to anticipate a coming need for maximum power. For example, when a vehicle is equipped with the invention, maximum pressure could be built up prior to passing another vehicle or making a quick start from rest. Generally described, this feature of the invention provides a fluid-driven power plant, comprising fluid handling means containing a substantially constant system volume of fluid under pressure, the fluid handling means comprising an output cylinder including an output piston capable of a fill stroke and an output stroke; a balance cylinder in fluid communication with the output cylinder; means for operating the balance cylinder to deliver fluid to the output cylinder during the fill stroke; an accumulator in fluid communication with the output cylinder, the operating pressure level of the accumulator being higher than the pressure within the balance cylinder; a fluid-driven motor having a port in fluid communication with the accumulator; power level selector means for generating a power level signal corresponding to a desired power output of the plant; means for operating the output cylinder to maintain the pressure in the accumulator at a level sufficient to provide the desired power output; and means for selectively causing the output cylinder to increase the pressure in the accumulator to a maximum level regardless of the level required to provide the power output corresponding to the power level signal.

The present invention also provides an additional control for varying the performance level of responsiveness of various positions of the power input control. The sensitivity of the power input control (such as a traditional "gas pedal") is thus not fixed depending on the weight of the vehicle and the horsepower capability of the engine. Rather, it can be adjusted according to conditions of road and traffic. Generally described, this feature of the invention provides a power plant comprising means for generating output power; means for varying the level of power generated by the generating means; power level selector means for generating a power level signal in a range from a minimum level to a maximum level, corresponding to a plurality of positions of the power level selector; performance selector means for varying the maximum level and for varying the magnitude of the signal corresponding to each of the positions of the power level selector; and control means responsive to the power level signal for operating the means for varying the level of power generated by the generating means.

Thus, it is an object of the present invention to provide an improved fluid-driven power plant.

It is a further object of the present invention to provide a power plant in which the combustion stroke length can be automatically adjusted.

It is a further object of the present invention to provide a fluid-driven power plant, driven by combustion, which has a constant, pressurized system volume, and which maintains a greater pressure drop across a fluid motor than formerly possible without diminishing the efficiency of the compression stroke.

It is a further object of the present invention to provide a fluid-driven power plant having a combustion cylinder which automatically compensates for misfires and variations in the heating value of fuel being burned.

It is a further object of the present invention to provide a combustion driven fluid power plant in which the combustion components are configured to balance forces generated by such components.

It is a further object of the present invention to provide a fluid-driven power plant in which the sensitivity of the power demand controls can be adjusted.

It is a further object of the present invention to provide a fluid-driven power plant in which a future demand for high power output can be anticipated.

Other objects, features and advantages of the present invention will become apparent upon reading the following detailed description, with reference to the drawing.

DETAILED DESCRIPTION

Figure 1A:
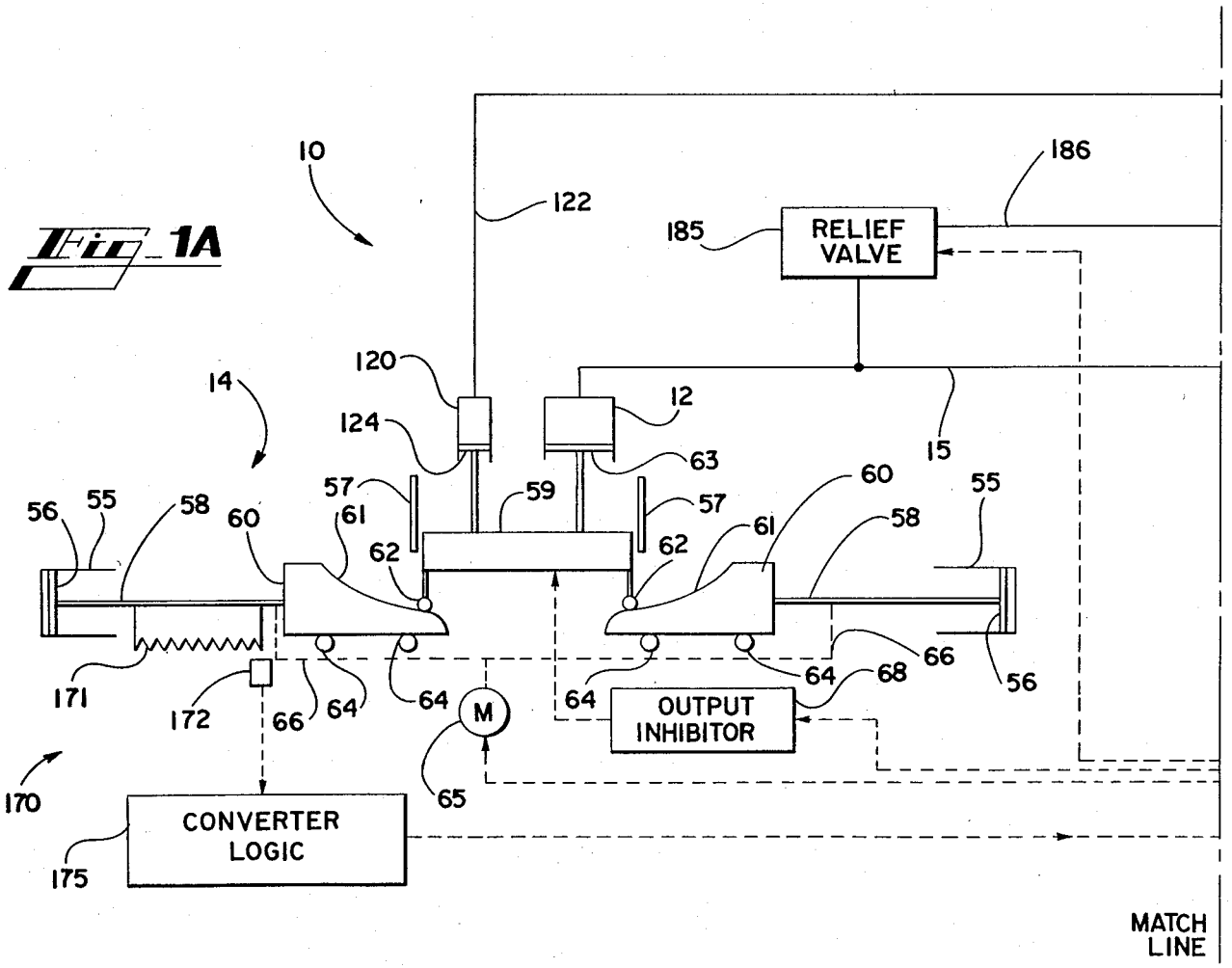
FIGS. 1A and 1B are a schematic hydraulic circuit diagram showing a fluid-driven power plant embodying the invention.
Figure 1B:
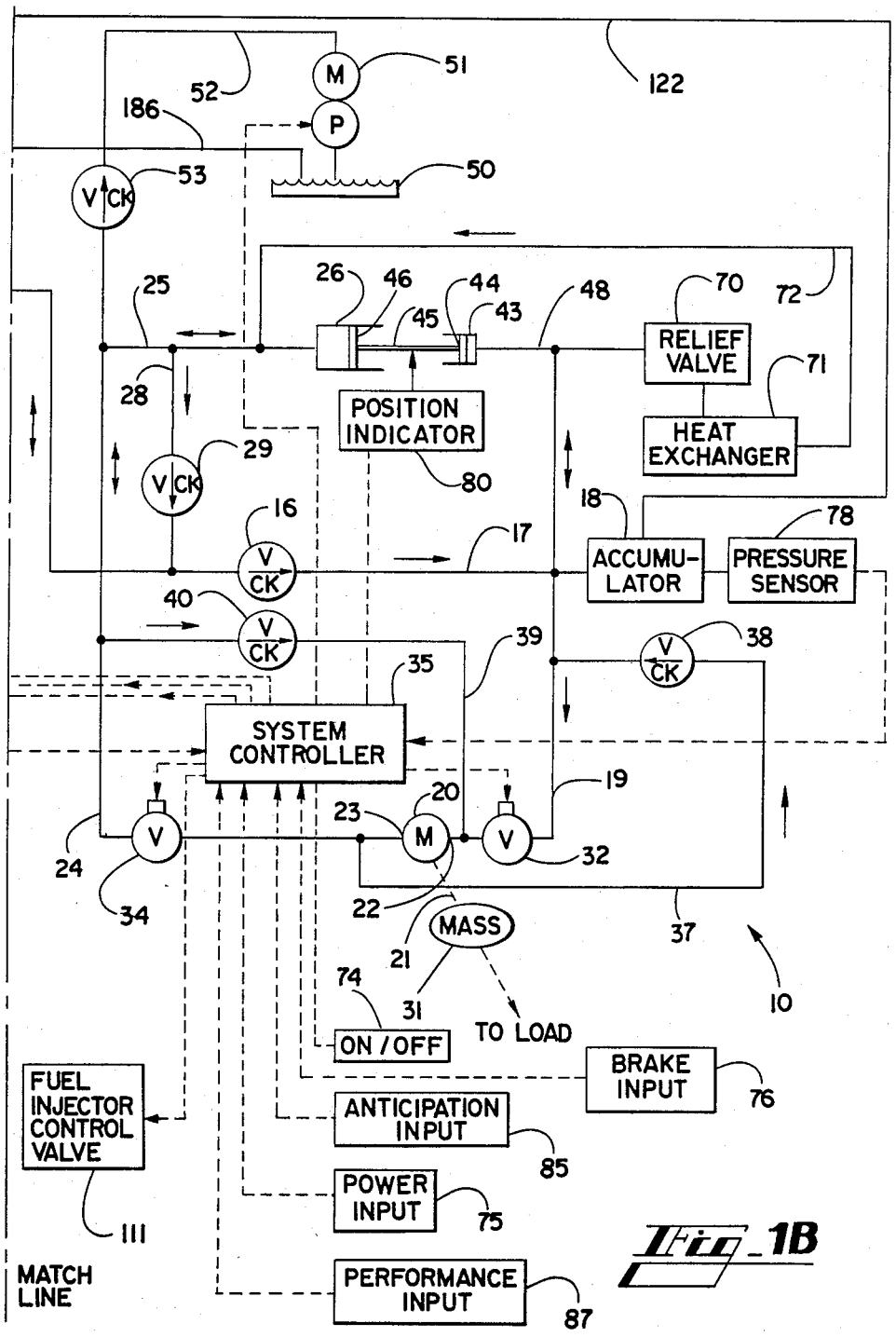

Referring now in more detail to the drawing, in which like numerals refer to like parts throughout the several views, FIG. 1 shows diagrammatically a fluid driven power plant 10 embodying the present invention.

The fluid handling means of the power plant comprises a closed, pressurized system generally including internal combustion means for increasing the pressure in an accumulator, balancing means for assuring that a sufficient amount of the system volume is available to increase the pressure in the accumulator, and a drive motor for converting the energy stored in the accumulator into rotary motion. Operation of the essentially closed system under pressure allows the system to move between minimum and maximum accumulator operating pressures more smoothly and rapidly than in systems which exchange fluid with an ambient pressure reservoir.

Such a fluid driven power plant 10 is shown in FIG. 1. The power plant 10 includes a fluid output cylinder 12 which is similar in construction and purpose to the compression cylinder shown and described in my previous application Ser. No. 514,167, now U.S. Pat. No. 4,541,243, which is expressly incorporated herein by reference in its entirety. The output cylinder 12 is a standard hydraulic cylinder modified in a well-known manner to allow the fluid to flow rapidly into and out of the cylinder. Fluid output from the output cylinder 12 is enabled by an output operating means 14, which is internally combustion driven and is described in more detail below. Fluid output from the cylinder 12 travels along a fluid line 15 through an output check valve 16 and through a fluid line 17 to an accumulator 18. The check valve 16 prevents fluid flow from an accumulator 18 back to the output cylinder 12. The accumulator 18 is preferably the type in which liquid flow within the system is compressed against a chamber containing an inert gas.

In the embodiment shown in FIG. 1, high pressure fluid from the accumulator 18 can travel along a fluid line 19 into a high pressure inlet 22 of a fluid-driven motor 20. The motor 20 converts the energy of the high pressure fluid into rotary motion of a mechanical linkage 21, which is connected to a load. The linkage 21, for example, a drive shaft, can include a mass 31 for smoothing the output from the drive motor 20, particularly when the motor 20 is being controlled in a pulsed mode as described below.

It should be understood that the word "motor" is used broadly herein to include any fluid driven device used to perform work.

The fluid from the accumulator 18 exits the drive motor 20 from a low pressure outlet port 23 and then passes along fluid lines 24 and 25 to a balance cylinder 26. The balance cylinder 26 is a conventional hydraulic cylinder again modified to allow rapid movement of fluid into or out of the cylinder. The balance cylinder 26 has multiple functions, including the following. It provides fluid under pressure to the output cylinder 12 during the compression stroke of the output operating means 14. It acts as an adjustable fluid storage means within the fixed volume, closed system 10, providing additional fluid for increasing the pressure in the accumulator 18 when desired, and accepting excess system fluid when the accumulator 18 is operated at a lower pressure. As a low pressure storage means, it provides the pressure drop across the motor 20 necessary to operate the motor. Also, it provides fluid during braking. To enable these functions, balance cylinder 26 is connected to the fluid lines 15 and 17 by a fluid line 28 which includes an input check valve 29 which prevents fluid flow in the line 28 toward the balance cylinder 26. The output check valve 16 is located in the fluid line 17 between the accumulator 18 and the intersection of fluid lines 28 and 15, so that fluid from the balance cylinder 26 can flow through the line 28 and the line 15 to the output cylinder 12.

Fluid flow from the accumulator 18 through the drive motor 20 and on to the balance cylinder 26 is controlled by a pair of standard hydraulic valves, a drive valve 32 located between the accumulator 18 and the motor 20 in the fluid line 19, and a brake valve 34 located in the line 24. The hydraulic valves 32 and 34, in addition to other elements of the power plant, are controlled by a system controller 35. The system controller 35 is an electronic device capable of receiving signals from various sensors in the power plant system and providing control signals to various control devices such as the hydraulic valves. The system controller is preferably a programmed digital computer or microprocessor, the programing of which could be done routinely by a programmer of ordinary skill in the art given the required functions of the system controller as described in detail hereinafter.

To enable the braking operation, described below, a fluid line 37 connects the low pressure outlet 23 of the motor 20 to the accumulator 18. The line 37 includes a brake check valve 38 which prevents fluid from flowing from the accumulator 18 to the motor 20 along the line 37. Lower pressure fluid than that in the accumulator is supplied to the inlet 22 of the motor 20 from the balance cylinder 26 along fluid line 39, which includes an anti-cavitation check valve 40. The check valve 40 prevents fluid flow along the line 39 back toward the balance cylinder 26.

Operation of the balance cylinder 26 is controlled by a compression pressure cylinder 43 which is positioned adjacent to the balance cylinder 26. The compression pressure cylinder 43 includes a compression control piston 44 which is linked by a piston rod 45 to a balance cylinder piston 46 of the balance cylinder 26. The compression pressure cylinder 43 is connected along a line 48 to the accumulator 18, and has a cross sectional area less than the area of the balance cylinder 26. This results in the pressure of fluid in the balance cylinder 26 being lower than that within the compression pressure cylinder 43 and the accumulator 18. The fluid line 48 can carry the normal system fluid and be connected to the liquid side of the accumulator, or it can carry gas and be connected to the gas side of the accumulator.

The cylinder 43 is also a modified conventional hydraulic cylinder which allows rapid movement of fluid into or out of the cylinder. Preferably, the area of the compression cylinder 43 is about 20–30 percent of the area of the balance cylinder 26. The result of the differential in area is that the pressure within the balance cylinder 26 is maintained at 20–30 percent of the pressure in the accumulator 18. In the system disclosed in my prior application, this lower pressure within the balance cylinder 26 had to be high enough to perform the function of operating the output cylinder 12 in the compression stroke. This requirement for pressure in the balance cylinder 26 restricted the pressure drop across the motor 20 and thus limited the power output of the power plant 10 for a given fluid flow through the motor 20.

In order to maximize the power output for a given amount of fluid flow through the motor 20, the power plant shown in FIG. 1 includes a compression acceleration cylinder 120. The operation of a piston 124 within the compression acceleration cylinder 120 is linked to the output cylinder 12 in a manner described below. The cylinder 120 is directly connected to the accumulator 18 along a fluid line 122. Thus, the relatively high pressure of the accumulator 18 assists the balance cylinder 26 in operating the output cylinder 12 in the compression stroke. Since the balance cylinder 26 does only a portion of the work required for the compression stroke, it can be operated at a lower pressure, increasing the pressure drop across the motor 20. Furthermore, the compression acceleration cylinder 120 would allow for a shorter compression stroke, increasing the response time of the system to a demand for increased accumulator pressure.

The minimum pressure at which the balance cylinder 26 is operated is determined according to the design of the power plant 10. A minimum pressure will be required to obtain a required fluid velocity through the fluid lines, which can vary in diameter. Also influencing the balance cylinder pressure will be the horsepower of the motor 20, and the rate at which the output operating means 14 pulses the output cylinder 12. The pressure will be maintained sufficiently above ambient pressure to avoid any suction occurring within the system. Once the minimum balance cylinder is determined, the size of the compression acceleration cylinder 120 can be selected to provide sufficient power to operate the compression stroke. The addition of the cylinder 120 could allow the balance cylinder 26 to operate at a minimum pressure as low as 5–10% of the accumulator minimum pressure.

In order to cooperate properly with the output cylinder 12, the compression acceleration cylinder 120 is smaller in area than the output cylinder. Depending on the system design parameters described above, one could find that the compression acceleration cylinder 120 should be one-third the size of the output cylinder 12 or shares the work of the compression stroke equally with the output cylinder 12. The cylinder 120 would also reduce significantly the volume of fluid flow between the output cylinder 12, the balance cylinder 26, and the accumulator 18. Since the fluid line 122 connecting the compression acceleration cylinder 120 to the accumulator 18 has no check valves, dividing the fluid flow used for compression and accumulator buildup has the additional advantage of reducing the fluid flow through the check valves associated with the balance cylinder 26, and the output cylinder 12.

Although the power plant 10 is a closed system, leaks may develop resulting in the loss of fluid from the system volume. Therefore, a reservoir of fluid 50 is connected to the balance cylinder 26 by a fluid line 52 which includes a fluid motor/pump 51 which is controlled by the system controller 35. A fluid balance check valve 53 prevents fluid from the system from flowing back to the reservoir 50 and thus maintains the closed system.

The operating means 14 for driving the output cylinder 12 is similar to the internal combustion components described in my previous application, but is significantly improved to provide dynamic balance and improved monitoring of combustion performance. A pair of combustion cylinders 55 include combustion pistons 56 fixed to shafts 58. The shafts are positioned along a colinear axis, and the pistons mounted in opposed relation to reciprocate in opposite directions for dynamic balance. Each shaft 58 is fixed at its opposite end to one of a pair of cams 60 which each have a cam surface 61 shaped according to the particular criteria described below in connection with FIG. 2. The cams are confined for movement along the axis by idler rollers 64 or the like. A cam follower 62 engages each cam surface 61 and is attached to the piston rod of an output piston 63 which reciprocates within the output cylinder 12.

A mass is formed from parts of the combustion cylinder pistons 56, the cams 60 and the connecting shafts 58. This mass is sized and distributed among such parts for the purpose of storing energy at the beginning of the compression and power strokes and to give up this energy at the end of these strokes to provide a smooth operation of the combustion cylinders. Depending on the design of the output operating means 14, the total mass might be 40–80 pounds, for example.

Figure 2:
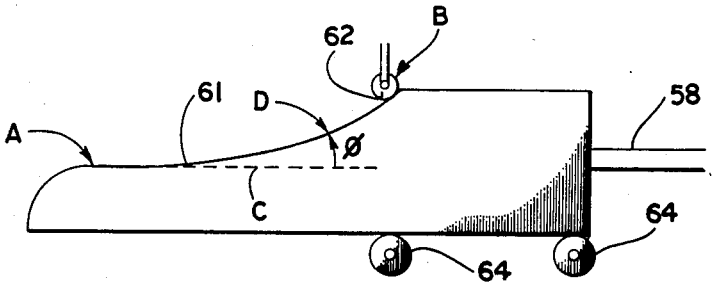
FIG. 2 is a diagrammatic representation of a cam as used in the power plant of FIG. 1.

As shown in FIG. 2, the cams 60 define a cam surface 61 which extends from point A farthest from the combustion cylinder, to point B, closest to the combustion cylinder. As the slope 61 extends from the point A to point B, the angle of the slope with respect to the axis of the combustion cylinder piston 18 may be made up of areas of constant slope and gradually increasing slope, or may be made up entirely of a gradually increasing slope. The dashed line C in FIG. 2 represents a line parallel to the axis of the combustion cylinder piston 56, and the slope of the cam surface 61 at any point along the cam surface is represented by the angle $\phi$. The shape of the cam surface 61, that is, the change in the angle $\phi$ from point A and point B, is that shape which results in substantially uniform transfer of the energy of combustion within the combustion cylinder 55 to the output cylinder piston 63 over the entire length of the combustion or power stroke. The shape of the cam surface 61 thus depends upon the parameters of combustion within the combustion cylinder 55, the total mass of the cams 60, shafts 58, and pistons 56, the desired speed of the output cylinder piston 63, and the angle between the axis of the piston 63 and the cam surface 61. Depending upon such factors, the cam surface 61 might, for example, begin at point A at a slope defined by the angle $\phi$ being between 0–15 degrees and gradually increasing until, at point B, the angle $\phi$ lies between 15–45 degrees. Such values for the angle $\phi$ are given by way of example only, and are not meant to exclude steeper slopes at either end of the cam surface 61. The manner in which the shape of the cam surface is determined will become apparent upon consideration of the operation of the embodiment shown in FIG. 1, as described below.

At the beginning of a power stroke, the cams 60 are positioned so that the combustion pistons 56 are fully inserted into the combustion cylinder 55. At this time, the cam followers 62 are located on the cam surface 61 near the point A. Upon combustion, the initial surge of the combustion piston 56 and the connected cams 60 results in much less travel by the output piston 63, since the cam followers 62 are engaging the cam surface 61 where the angle $\phi$ is small. This allows the total mass of the cams 60, shafts 58, and pistons 56 to absorb most of the initial high forces developed by the burning fuel. As the cam followers 62 move up the slope of the cam surfaces 61, the output piston 63 and piston 124 pump fluid at a rate determined by the instantaneous slope of the cam surface 61 and the rate at which combustion piston 56 is moving. As the cam angle $\phi$ increases, output piston 63 moves farther, and pumps more fluid, for each unit of distance moved by the combustion piston 56. As the force of combustion decreases, the kinetic energy stored in the total mass is transferred into motion of the output piston 63 and fluid flow into the accumulator 18.

Given a particular combustion cylinder and a particular hydraulic circuit, the total mass and the shape of the cam surface 61 can be selected to optimize the length of the combustion stroke for more efficient combustion, to minimize the flow capacity required in the hydraulic circuit, and to provide substantially uniform output of hydraulic fluid from the output cylinder 12 during the combustion stroke. The cams 60 are used as a variable speed reducer to maintain a near constant speed of output piston 63 in relation to the varying speed of combustion piston 56. During the initial energy surge of the power stroke the cams 60 are also used to reduce the initial acceleration and speed of the output piston 63 without restricting the movement of the combustion piston 56 to the extent required in previous embodiments.

For example, the optimum combustion cylinder piston speed for the most efficient combustion could reach as high as 40–50 feet per second, whereas depending upon the area of the output cylinder piston its optimum velocity could be a maximum of 5–20 feet per second in order to maintain the fluid flow rate in the hydraulic circuit in an efficient range.

During the initial part of the power stroke when the pressure within the combustion cylinder is at its highest, the maximum velocity of the combustion cylinder piston is controlled by the total mass. In order to allow the mass to absorb most of the initial forces developed by the combustion process, the initial slope of the cam surface 61, near point A, is maintained at a small angle $\phi$ to permit maximum acceleration to allow for a short cycle time. As the combustion pressure reduces during the final part of the combustion stroke, the kinetic energy of the mass maintains the hydraulic fluid flow. Toward the end of the combustion stroke the combustion piston 56 will be slowing down, and therefore the angle $\phi$ of the final slope of the cam surface can be increased to the maximum near point B without causing the output cylinder piston 63 to be operated in an overspeed condition. This increase in the angle $\phi$ allows for the shortest possible stroke length for the best mechanical efficiency.

The structure connecting the cam followers 62 to the piston 63 is preferably a connecting link 59 confined for movement perpendicular to the axis of the combustion pistons 56 by tracks 57 or the like. However, the cams 60 move the connecting link 59 linearly at right angles to the piston motion, so that no side thrust is exerted on the tracks or the piston 63 of the output cylinder 12.

A piston 124 within the compression acceleration cylinder 120 is also connected to the connecting link 59. Fluid within the compression acceleration cylinder 120 is thus cycled back and forth to the accumulator 18 as the connecting link 59 is moved by the cams 60. Rigid connection to the cam followers as shown is one manner of linking the compression acceleration cylinder 120 and the output cylinder 12.

Figure 4:
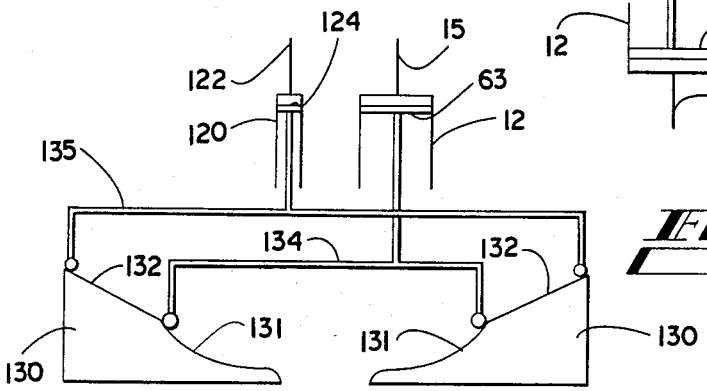
FIG. 4 is a diagrammatic representation of an alternate cam configuration for linking the compression and accelerator pistons to the combustion pistons.

Another structure which can be substituted in order to coordinate the compression acceleration cylinder 120 with the output cylinder 12 is shown in FIG. 4. Cams 130 are substituted for cams 60, and each define a first surface segment 131 identical to the cam surface 61, and a second surface segment 132, which is steeper than the segment 131. A separate cam follower linkage 134 drives the output piston 63 according to the slope of segments 131. Another cam follower linkage 135 drives the compression acceleration piston 124 according to the slope of the segments 132. It will be seen that the steep slope of the segments 132 causes the compression acceleration cylinder 120 to move the combustion piston 56 faster during the compression stroke than the configuration shown in FIG. 1.

When the configuration shown in FIG. 4 is utilized, the compression acceleration piston 124 will travel farther than the output piston 63 because of the steeper slope of segments 132. Therefore, to maintain the desired relationship between the compression acceleration cylinder 120 and the output cylinder 12, the area of the compression acceleration cylinder 120 must be decreased to compensate for the longer distance travelled by the compression acceleration piston 124, according to physical relationships well known to those skilled in the art.

When a liquid/gas accumulator is utilized for the accumulator 18, the compression acceleration cylinder 120 can be connected to the gas side of the accumulator rather than the liquid side, by making the line 122 a gas line and the cylinder 120 a gas cylinder. This substitution could be made in the embodiment of FIG. 4 and well as in the embodiment of FIG. 1. Since gas can travel within fluid lines at very high velocities without the heat losses associated with liquids such as hydraulic oil, using gas as just described is very efficient. The gas substitution could be made either in an opposed piston arrangement with two cams, as shown, or in a system having only one combustion piston and cam.

Figure 7:
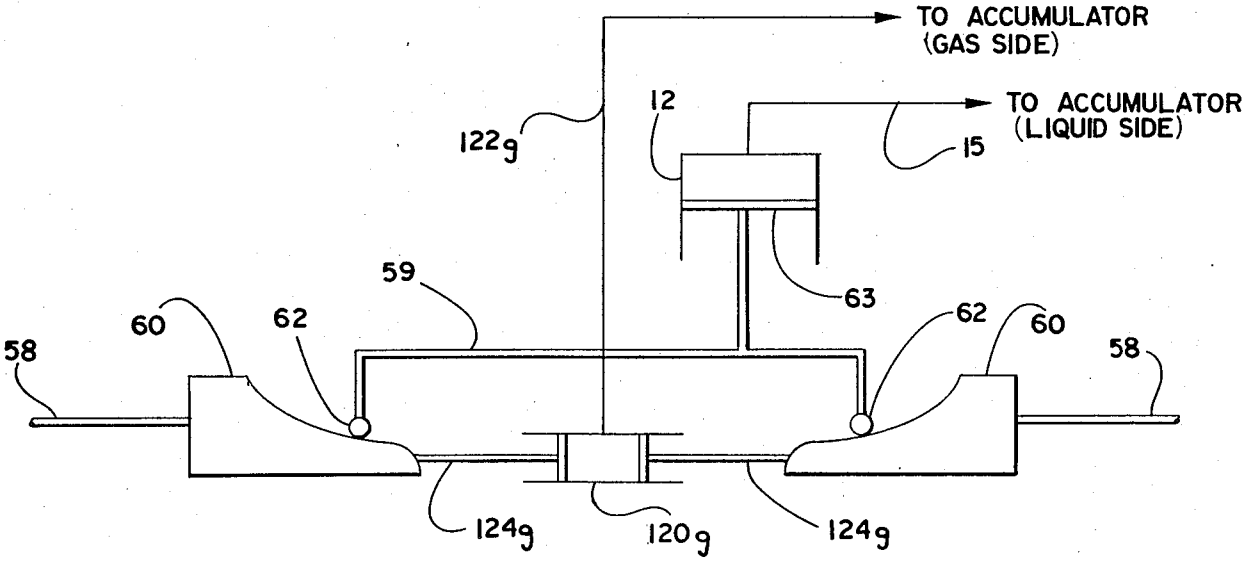
FIG. 7 is a diagrammatic representation of an alternate configuration for the compression acceleration cylinder of FIG. 1.

FIG. 7 shows an alternate configuration for a gas compression acceleration cylinder **120*g*. The cylinder 120*g* is open at both ends and is disposed along the axis of motion of the combustion piston rods 58. The cylinder 120*g* receives a pair of acceleration pistons 124*g* is connected directly to the cams 60. The gas cylinder 120*g* is connected directly to the gas side of the accumulator 18 by a gas line 122*g*. During the compression stroke, gas at the accumulator pressure enters the cylinder 120*g*, and its energy is converted into force on the combustion pistons directly along the path of the pistons. Similarly, during the power stroke, the force of combustion is transmitted directly to the pistons 124*g* which compress the gas in the cylinder 120*g*. This causes gas to be pumped into the accumulator 18**, thereby raising the pressure of the liquid operating fluid. All of the advantages of the compression acceleration cylinder are realized whether it is provided as a liquid cylinder or a gas cylinder.

Figure 3:
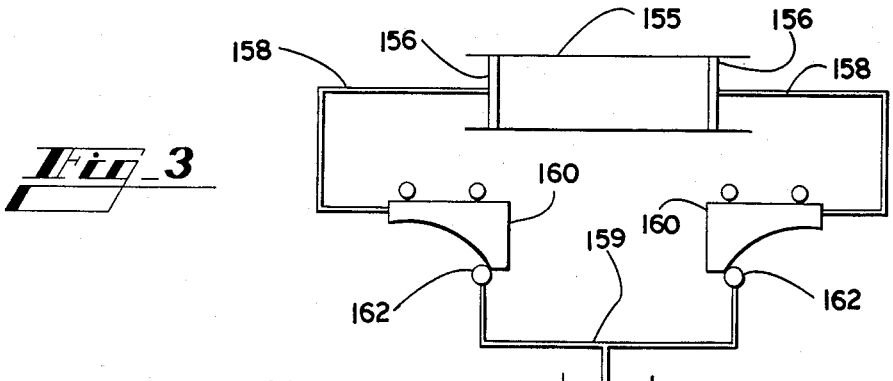
FIG. 3 is a diagrammatic representation of an alternate arrangement of combustion cylinders capable of use in the power plant of FIG. 1.

An alternate configuration for the balanced combustion pistons is shown in FIG. 3. A single elongate combustion cylinder 155 is provided and receives a pair of combustion pistons 156 at opposite ends of the cylinder 155. Combustion takes place at the center of the cylinder 155, driving the pistons 156 apart with equal force. A pair of linkages 158 connect the pistons 156 to cams 160, and pull the cams apart during the combustion stroke rather than pushing them together as shown in FIG. 1. Cam followers 162 engage the cams 160, carry a connecting link 159 and are connected to the output piston 63 of the output cylinder 12. As shown in FIG. 3, only the output piston is utilized. However, it will be understood that a compression acceleration cylinder can be provided, either in the configuration shown in FIG. 1 or in the configuration shown in FIG. 4.

Thus, the output operating means 14 is a two stroke internal combustion device which operates with a compression stroke in which fuel and gases are compressed within the combustion cylinders 55 followed by ignition and a power stroke in which the cams 60 drive the pistons 63 and 124 into the output cylinder 12 and the compression acceleration cylinder 120, respectively, causing fluid to be output under pressure into the line 15 and on to the accumulator 18. The combustion cylinder 55 preferably includes the input controls for fuel, air, water and the like, as described and shown in U.S. Pat. No. 4,459,084, which is expressly incorporated herein by reference in its entirety.

Figure 6:
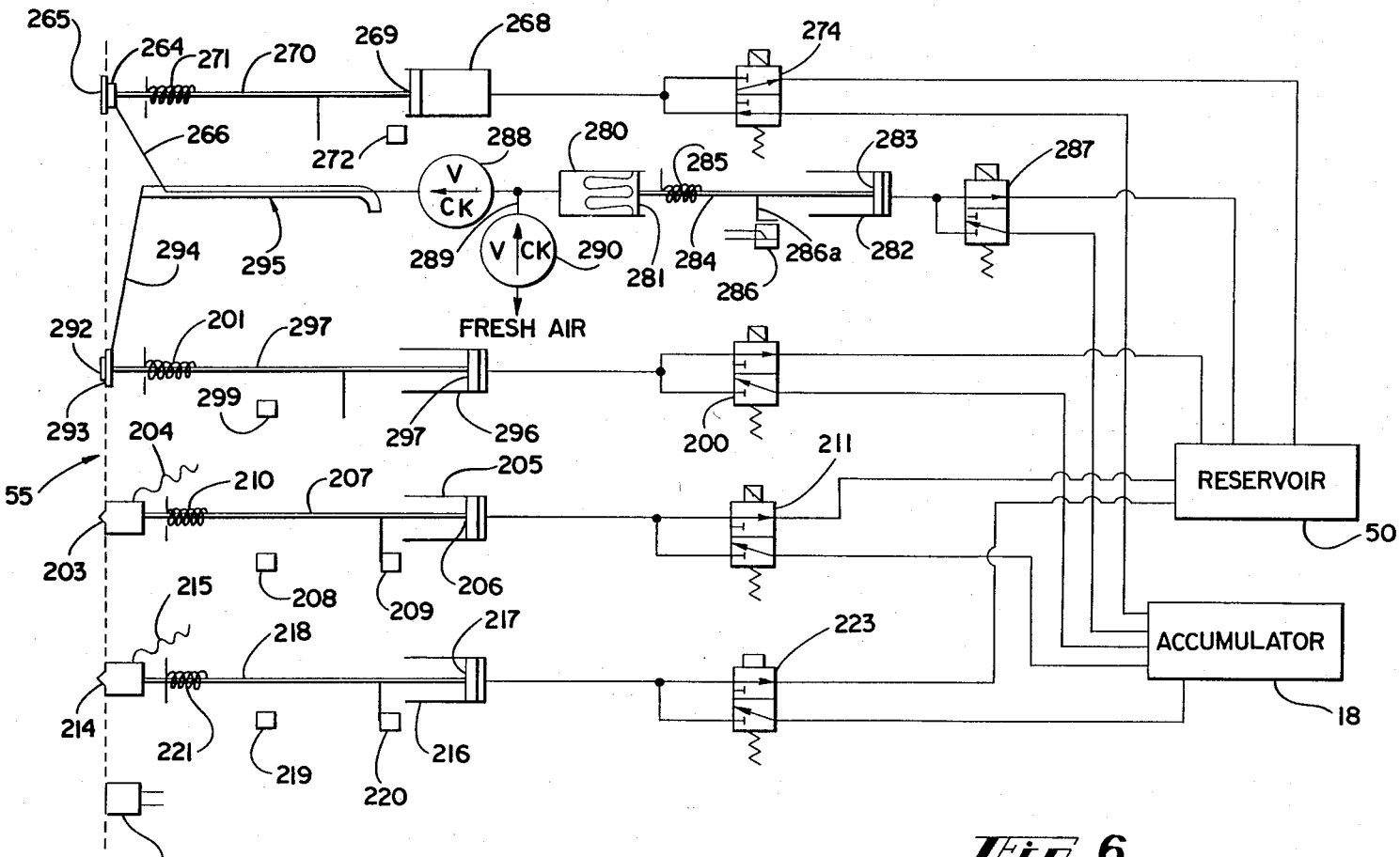
FIG. 6 is a diagrammatic representation of inputs to the combustion cylinders of FIG. 1.

The intake and exhaust devices associated with each combustion cylinder head 55 are shown in FIG. 6. The system controller 35 coordinates such devices for each cylinder 55 so that they are operated in an identical manner. The surface of the combustion cylinder head is represented diagrammatically by a vertical dashed line. An intake valve 264 operates against an intake valve seat 265 and opens to the exterior of the combustion cylinder 55. Air is supplied into the cylinder 55 through an opening defined by the valve seat 265, from an air input pipe 266. An intake valve operating cylinder 268 includes a piston 269 which is connected to the intake valve 264 by a connecting rod 270, which is biased by an intake valve spring 271 away from the cylinder head 55. The connecting rod 270 passes through a sealed opening in a wall of the air input pipe 266 in a manner which is well known and therefore not shown. The stroke of the piston 269 into the intake valve operating cylinder 268 is limited by a mechanical stop 272. Operation of the intake valve operating cylinder 268 is determined by an intake valve cylinder control valve 274. The valve 274 is an electrically operated solenoid valve which alternately connects the operating cylinder 268 to the accumulator 18 or to the reservoir 50.

A pneumatic air input cylinder 280 is connected to the air input pipe 266 for forcing air through the intake valve 264. The cylinder 280 includes a piston 281. An air drive hydraulic cylinder 282 is disposed in linear relationship with the pneumatic cylinder 280, and includes a piston 283 that is directly connected to the piston 281 by a connecting rod 284. A return spring 285 biases the connecting road 284 and connected pistons toward the hydraulic drive cylinder 282. Full retraction of the air input piston 281 out of the air input cylinder 280 is detected by an air drive position detector 286 which is activated by a trigger **286*a*. The air drive hydraulic cylinder 282 is operated by an air drive cylinder control valve 287, which is an electrically operated solenoid valve which alternately connects the cylinder 282 to the accumulator 18 or to the reservoir 50. An air delivery check valve 288 is provided in the air input pipe 266 to prevent air from returning to the air input cylinder 280. The air input cylinder 280 is refilled from atmosphere through an air conduit 289 that includes an input check valve 290**.

An exhaust valve 292 opens inwardly into the cylinder head 55, passing through an opening defined by an exhaust valve seat 293. Exhaust is conducted through an exhaust pipe 294 to atmosphere. For a substantial portion of the length of the air input pipe 266, the exhaust pipe jackets the air input pipe and is connected thereto by metallic fins, to form a heat exchanger 295. The exhaust valve is opened and closed by an exhaust valve operating hydraulic cylinder 296, which includes a piston 297. The piston 297 is directly connected to the exhaust valve 292 by a connecting rod 298, and an exhaust valve return spring 201 biases the exhaust valve toward the operating cylinder 296, that is, into the closed position. A mechanical stop 299 limits the movement of the piston 297 toward the cylinder head 55. Operation of the exhaust valve operating cylinder 296 is controlled by an exhaust valve operating cylinder control valve 200, which is an electrically operated solenoid valve which alternately connects the exhaust valve operating cylinder 296 to either the accumulator 18 or the reservoir 50.

A fuel injector 203 of a type known to those skilled in the art is also associated with the cylinder head 55, and injects fuel supplied by a fuel line 204. The fuel injector is operated by a fuel injector drive cylinder 205 which includes a piston 206. The piston 206 is directly connected to the fuel injector 203 by a connecting rod 207, and the connecting rod 207 is biased toward the fuel injector cylinder 205 by a return spring 210. Travel of the connecting rod 207 and piston 206 toward the fuel injector 203 to activate the fuel injector is limited by a mechanical stop 208, and travel in the opposite direction into the fuel injector drive cylinder 205 is limited by a mechanical stop 209. The fuel injector drive cylinder 205 is operated by a fuel injector control valve 211, which is an electrically operated solenoid valve which connects the drive cylinder 205 to either the accumulator 18 or the reservoir 50.

Also associated with the cylinder head 55 is a water injector 214 which can be similar in construction to the fuel injector 203 and supplies water from a water line 215. The water injector 214 is operated by a water injector drive cylinder 216, which includes a piston 217. The piston 217 is directly connected to the water injector 214 by a connecting rod 218, and the connecting rod 218 is biased toward the drive cylinder 216 by a water injector return spring 221. Travel of the connecting rod 218 and the piston 217 toward the water injector to activate the water injector is limited by a mechanical stop 219, and travel in the opposite direction is limited by a mechanical stop 220. The water injector drive cylinder 216 is operated by a water injector control valve 223, which is an electrically operated solenoid valve which alternately connects the water injector cylinder 216 to either the accumulator 18 or the reservoir 50.

A heat sensor 225 of conventional construction is also mounted with respect to the cylinder head 27 to measure the temperature of the combustion cylinder 55.

In the power plant 10, a reversible electric sequence motor 65 is connected by a pair of mechanical drive linkages 66 to the shafts 58. The linkages 66 are geared together and designed to enable reciprocation of the shafts 58 and attached pistons 56 and cams 60, and therefore can be any appropriate linkage, such as a rack and pinion or pulley arrangement. The motor 65 is operated by the system controller 35 to reciprocate the shafts 58 when necessary in order the start the power plant by building up initial pressure in the accumulator 18, or to change the position of the pistons 56.

Also provided as part of the output operating means 14 is an output inhibitor 68 shown diagrammatically in FIG. 1. The output inhibitor 68 is preferably a brake mechanically associated with the connecting link 59 and could be similar to an automobile disc brake having pads electrically or hydraulically operated to clamp upon a linear plate to hold the connecting link in a selected position and thereby prevent the cams from being operated. The output inhibitor is controlled by the system controller 35 and normally is applied to fix the position of the associated components of the operating means 14 when cycling of the means 14 is to cease and the cam has been positioned at the correct position for a subsequent cycle in accordance with the current accumulator pressure. It should be understood that the output inhibitor 68 could be configured to operate physically either on a cam, on a piston shaft, or on the motor 65, as alternatives to its operation on the connecting link 59.

The output operating means 14 also includes improved detection device 170 for locating the position of the combustion pistons 56 and for mapping their speed during the combustion stroke. A pulse counting device for this purpose is shown in FIG. 1, in which a toothed gear 171 or other member having a series of ferromagnetic projections is fixed for travel with one of the shafts 58. A conventional magnetic pickup device 172 is positioned adjacent to the path of the gear 171, and provides electrical signals as the teeth of the gear pass the pickup 172. Also, uniquely shaped projections (not shown) can be spaced along the gear 171 to indicate special locations of the shaft 58, such as the end of the compression stroke or of the combustion stroke.

A signal from the magnetic pickup 172 is sent to a converter logic circuit 175, where the pulses detected by the pickup are converted to signals representing the position and speed of the shaft 58 and associated piston 56 and cam 60. The position and speed signals are then sent to the system controller 35. Alternately, the electronic logic circuits of the converter logic circuit 175 can be a part of the system controller.

Figure 5:
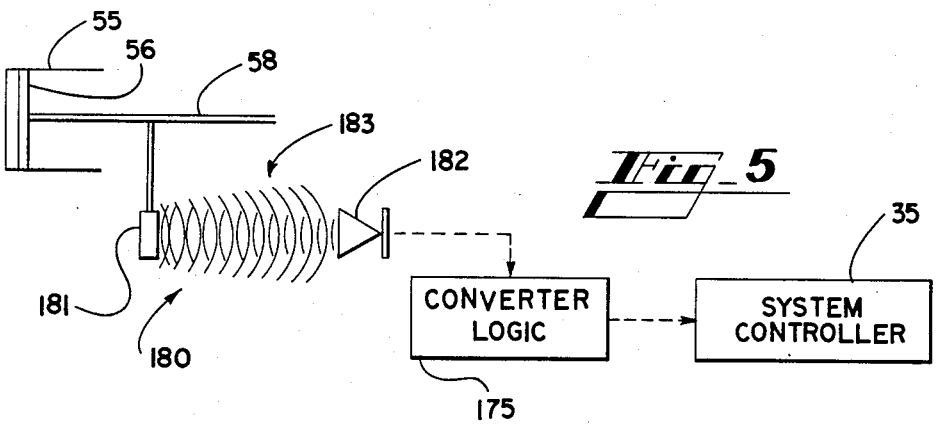
FIG. 5 is a diagrammatic representation of an alternate embodiment of the piston speed measuring apparatus, utilizing a radar or sonar device.

An alternate detection device 180 is shown in FIG. 5. The device 180 includes a reflective target 181 fixed for travel with the shaft 58. A radar transmitter/receiver 182 is aimed at the target 181 and transmits waveforms 183 at the target continuously. If the target 181 is immersed in lubricant, a sonar transmitter/receiver is used. The waveforms reflected from the target 181 are picked up by the receiver, and signals representing the position and speed of the shaft 58 are sent to the converter logic circuit 175.

The information provided to the system controller 35 by the devices 170 to 180 can be utilized in connection with the sequencing motor 65 to properly position the combustion pistons for subsequent strokes. Also, if a partial misfire results in slower piston speed, the sequence motor can by used to move the pistons to the location they should have reached.

Alternately, a relief valve 185 can be provided connected to the fluid line 15 which connects the output cylinder 12 to the accumulator 18. A drain line 186 connects the relief valve 185 to the reservoir 50. When slow piston speed is detected, the system controller sends a signal to open the relief valve 185, eliminating resistance to motion of the output piston 63. The force of combustion then is able to increase the speed of the pistons 56 until the loss of speed is recovered, at which time the relief valve is closed. The slight loss of system fluid volume is automatically made up by the pump 51. The recovery steps just described are intended for partial misfires, with sufficient power being generated to operate the compression acceleration cylinder 120. If a full misfire occurs, the sequence motor is operated to reset the pistons for another compression stroke.

The detected speed of the pistons can also be used to evaluate the heating value of the fuel being used. In response to the speed information, the system controller 35 can send a signal to a fuel injector control valve 111, similar to that shown in U.S. Pat. No. 4,459,084. The injector valve 111 can thus be adjusted to provide more or less fuel to the combustion cylinders 55 depending on the heating value of the fuel. Preferably, piston speed would be monitored over several successive firings to obtain average values indicative of fuel performance, and then appropriate adjustments would be made.

It is possible that the maximum operating pressure of the accumulator 18 may be exceeded during extended braking applications. Therefore, a standard relief valve 70 is provided in a fluid line 72 connecting the accumulator 18 to the balance cylinder 26. Any occurrence of an increase in the operating pressure above the preset level of the relief valve 70 will result in fluid flow along the line 72. Since heat is generated when the pressure level of the fluid drops from the operating pressure to the compression pressure level of the balance cylinder 26, a heat exchanger 71 of conventional construction is also provided in the fluid line 72 to dissipate such heat.

In operating the elements of the power plant 10, the system controller 35 depends upon input signals from sensors located at key points in the system. Manual operator controls are provided in the form of an on/off control 74, a power input control 75 which sets the level of power requested to rotate the load, a brake control input 76 which sets the level of braking power requested to decelerate the load, an anticipation input control 85, and a performance input control 87.

The anticipation input control 85 provides a signal which causes the system controller 35 to operate the output operating means 14 continuously until maximum accumulator pressure is reached, independent of the current demand for accumulator pressure represented by the level of the power input control 75. Such a control allows the operator to anticipate a coming need for maximum power. For example, when a vehicle is equipped with the invention, maximum pressure could be built up prior to passing another vehicle while maintaining a low speed until the time for acceleration arrives. Another occasion for building up accumulator pressure in advance would be to make a quick start from rest. The power input control 75 provides a means for selecting a power level in a range from a minimum level to a maximum level, corresponding to a plurality of positions of the input control 75. The performance input control 87 provides a signal to the system controller 35 to modify the signal received from the power input control 75, in order to vary the sensitivity of the power input control. This is done by causing the system controller to vary the maximum level demanded by the power input control, and the magnitude corresponding to each of the positions of the power input control. The performance level can thus be adjusted according to conditions of road and traffic. For example, a vehicle operator in a traffic jam could set the performance input control 87 to require a large relative movement of the power input control to obtain gradual acceleration of the vehicle. This would help to eliminate repeated jerky starts as the line of traffic moved forward.

A pressure sensor 78 is provided in fluid communication with the accumulator 18 to continuously provide the accumulator pressure level to the system controller 35. A balance position indicator 80 provides a signal to the system controller indicating the position of the balance cylinder piston. This piston position indirectly indicates the volume of fluid within the balance cylinder 26.

Having described the structure and arrangement of the elements of the power plant 10, the operation of the power plant can now be described. It should be noted that the power plant 10 operates at maximum efficiency by operating both the internal combustion energy input to the system and the output through the motor 20 intermittently according to demand. Thus, neither fuel nor stored energy in the accumulator are wasted during idling. Also, use of the motor in a braking mode uses the rotational energy of the load to store fluid pressure in the accumulator.

During start up of the power plant 10, if the operating pressure in the accumulator 18 (monitored by the sensor 78) is below the minimum level needed to develop sufficient pressure in the balance cylinder 26 to operate the output cylinder 12 and compression acceleration cylinder 120 in the compression mode to compress fuel and gases in the combustion cylinders 55, the system controller 35 receives the pressure signal from the pressure sensor 78 and in response cycles the sequence motor 65 to pump fluid into the main accumulator by reciprocating the output cylinder 12. During this time the combustion cylinders are not operational. When the minimum operating pressure has been reached, operation of the motor 65 is stopped. The position signal from the position indicator 170 is then compared with the accumulator pressure. If the position of the cams indicates that the compression stroke length will be appropriate in relation to the accumulator pressure, a signal will be sent by the system controller to engage the output inhibitor 68 to maintain the correct position. If the stroke length would be too short, the system controller will cause the sequence motor 65 to operate until the correct position is reached, and then engage the output inhibitor 68. Conversely, if the stroke is too long the output inhibitor will not be engaged until fluid pressure from the balance cylinder 26 has pushed the cam back to the correct position, and then the output inhibitor will be engaged. During startup, the correct position for the cams will be that which gives the longest length compression stroke since, the accumulator will begin at its minimum operating pressure level.

As the pressure builds in the accumulator 18, the pressure applied against the piston 44 of the compression pressure cylinder 43 will determine the position of the balance cylinder piston 46. The system controller 35 monitors the balance position indicator signal from the indicator 80 and determines whether the position of the balance cylinder piston 46 is correct assuming that the system fluid volume is at the correct level. If the position indicator signal does not indicate correct status of the system volume, the system controller will send a signal to the motor/pump 51 and cause it to pump fluid from the reservoir 50 through the line 52 and the line 25 to the balance cylinder 26, until the position of the piston 46 indicates a correct system fluid volume.

Once the accumulator operating pressure has reached the minimum value necessary for operating the combustion cylinders 55, and the cams 60 have been properly positioned, the output inhibitor 68 is disengaged. Fluid from the balance cylinder 26 is delivered along the lines 25 and 15 to the output cylinder 12, driving the output piston 63 and associated cam followers 62 into the cam 60. Fluid from the accumulator also is delivered directly along line 122 to the compression acceleration cylinder 120, which also drives the cams 60. The cams 60 and connected combustion pistons 56 are driven into the combustion cylinders 55, causing the pistons 56 to compress fuel and gases in the combustion cylinders 55. At the end of the compression stroke, either diesel or spark ignition is initiated, causing the pistons 56 and cams 60 to be driven out of the combustion cylinders 55. This results in driving the output piston 56 into the output cylinder 12, driving fluid through the line 15, the check valve 16 and the line 17 into the accumulator 18. The compression accelerator cylinder 120 also drives fluid into the accumulator 18.

The operator will now have set a requested power level by operating the power input control 75. The system controller 35 responds to the power demand by opening the drive valve 32 intermittently for a length of time sufficient to provide an average torque of the drive motor consistent with the demanded output torque. Graphic illustrations of a pulsed mode of operation are shown in U.S. Pat. No. 4,541,243. The mass 31 assists in smoothing the output torque applied to the load when the drive valve 32 is operating the motor 20 in a pulse mode.

The opening and closing duration of the drive value in the drive mode is determined by the instantaneous operating pressure in the accumulator and the power output requested by the operator. Thus, if the operating pressure in the accumulator is high and the operator is requesting minimum power, the drive valve is opened for only a very short time at fixed intervals, and closed for a longer period of time. As the operator requests a higher output and the operating pressure decreases, the length of time the drive valve is opened increases until the drive valve must be held open continuously to supply the power demanded by the operator.

Fluid flow during normal drive mode of operation is from the accumulator 18 through the drive value 32, through the drive motor 20, through the brake valve 34 (which is fully open in the drive mode), and to either the fluid balance cylinder 26 or the output cylinder 12 (through the fluid line 28 and the input check valve 29). Thus, the drive motor 20 drives the output linkage 21 and mass 31, and also acts as a pump to maintain the balance cylinder 26 and the output cylinder 12 at the compression pressure level required for a compression stroke.

When the accumulator pressure is reduced as the result of operating the motor 20, the system controller 35 determines when to cycle the output operating means 14 by comparing the accumulator pressure to the output demands of the operator. When the pressure thus determined is reached, the system controller disengages the output inhibitor 68, allowing fluid pressure generated by the balance cylinder 26 and the accumulator 18 to create a compression stroke which, when completed, results in ignition and a power stroke which drives fluid out of the output cylinder into the accumulator 18 to increase the operating pressure. During the power stroke, the fluid from the drive motor 20 is being stored in the balance cylinder 26 at the compression pressure which remains at a level lower than the operating pressure in the accumulator, as described above. So long as the system controller 35 determines that additional operating pressure is required, the output inhibitor remains disengaged, and cycling of the combustion cylinders 55 continues automatically. If the operator requests a greater output and the operating pressure must be increased, the cycling of the output operating means 14 continues to pump additional fluid volume into the accumulator 18, and this required volume of fluid is supplied by the balance cylinder 26. When the accumulator pressure is relatively high and the operator demands a relatively lesser output torque, the output inhibitor is engaged by the system controller to prevent the output operating means 14 from cycling until the system controller 35 determines that the accumulator pressure should be once again increased. As operation of the motor 20 decreases the operating pressure, fluid volume leaving the accumulator and passing through the motor is stored in the balance cylinder.

During the normal operation of the power plant 10, the system controller 35 continuously monitors the position indicator signal from the balance position indicator 80 and causes additional fluid to be pumped into the system by the motor/pump 51 if leakage has occurred. The position of the cams 60 is also monitored by the system controller by means of the signal from the position indicator 170, and whenever cycling of the output operating means 14 is about to be initiated, the position of the cams 60 is adjusted to provide a compression stroke of the proper length for the then current accumulator operating pressure.

The system controller also monitors the speed of the combustion pistons 56 and utilizes the sequence motor 65 or the relief valve 185 to recover from misfires. The fuel injector control valve 111 is adjusted to accommodate changes in the heating value of the fuel being used.

Under particular circumstances as described above, the anticipation input control 85 is used to maximize pressure in the accumulator in advance of a need for full power. The performance input control 87 is used to control the sensitivity of the power input control 75 when desired.

When the operator requests braking power by setting the brake input control 76, the system controller 35 closes the drive valve 32 and operates the brake valve 34 in an intermittent fashion similar to the operation of the drive valve during the drive mode described above. When the brake valve 34 is closed during the braking mode, fluid flows from the fluid balance cylinder 26 through the line 39 and the anti-cavitation check valve 40, through the motor 20, through the fluid line 37 and the brake check valve 38 into the accumulator 18. During lengthy braking applications, when the accumulator is charged to the maximum pressure, the fluid that is still flowing through the brake check valve 38 will pass through the relief valve 70 and heat exchanger 71 and through the line 72 to the balance cylinder 26.

It will thus be seen that the balance cylinder 26 and associated compression pressure cylinder 43 provide a balancing function in the closed fluid system of the power plant 10. Since the accumulator may hold three more gallons of fluid at its maximum operating pressure than it does at its minimum operating pressure, the total system volume must take this variation into account and provide a means for storing the excess volume when it is not needed, while providing the excess volume for pumping into the accumulator when it is needed. As described above, this function is provided by the balance cylinder 26.

A quick response to a demand for transferring such excess volume to go between low and high operating pressures is provided because the system operates at a pressure level above ambient pressure. The excess fluid need not be pumped to the operating pressure all the way from ambient pressure. Thus, The fluid flow in and out of the balance cylinder can be smoother and steadier, rather than operating with a jerky back and forth motion.

It will be understood that the embodiments of the present invention described above could be operated using conventional spark ignition rather than a compression ignition or diesel engine type of operation. This would require the addition of a conventional carburetor or fuel injection device for delivering fuel and air into the combustion cylinder, and a control system to fire the spark plug at the appropriate time.

With reference to all of the embodiments of the present invention described above, it should be noted that hydraulic fluid is fed to all of the cylinders by positive force upon the fluid rather than by suction. The hydraulic fluid thus provides a positive link between the components and no cavitation occurs within the hydraulic circuit. Also, the inertia of the hydraulic fluid flowing in the lines of the circuit adds to the work done by the system.

While this invention has been described in detail with particular reference to preferred embodiments thereof, it will be understood that variations and modifications can be effected within the spirit and scope of the invention as described hereinbefore and as defined in the appended claims.

What is claimed is:

1. A fluid-driven power plant, comprising:

fluid handling means containing a substantially constant system volume of fluid under pressure, said fluid handling means comprising:

an output cylinder including an output piston capable of a fill stroke and an output stroke;

a balance cylinder in fluid communication with said output cylinder;

means for operating said balance cylinder to deliver fluid to said output cylinder during said fill stroke;

means for operating said output cylinder to deliver fluid therefrom;

an accumulator in fluid communication with said output cylinder, the operating pressure level of said accumulator being higher than the pressure within said balance cylinder;

a compression acceleration cylinder in fluid communication with said accumulator and including an acceleration piston linked to said output piston: and a fluid-driven motor having a port in fluid communication with said accumulator;

said compression acceleration cylinder assisting said balance cylinder during said fill stroke.

2. The power plant of claim 1, wherein said output piston and said acceleration piston are linked by cam means defining a first cam surface engaging said output piston and a second cam surface engaging said acceleration piston, said second cam surface being steeper than said first cam surface.

3. The power plant of claim 2, wherein said means for operating said output cylinder comprises combustion means including a combustion cylinder and a combustion piston, and wherein said cam means drivingly connects said combustion piston with said output piston and said acceleration piston.

4. The power plant of claim 3, wherein said combustion means comprises a pair of opposed combustion pistons; and cylinder means for confining said opposed combustion pistons for reciprocating along a colinear path;

said cam means connecting both said combustion pistons to said output and acceleration pistons.

5. The power plant of claim 4, further comprising means for measuring the speed of said combustion pistons.

6. The power plant of claim 5, further comprising means responsive to said means for measuring the speed of said combustion pistons for adjusting the stroke length of said combustion pistons.

7. The power plant of claim 5, further comprising fuel means for supplying fuel to said combustion means and means responsive to said means for measuring the speed of said combustion pistons for adjusting the amount of fuel supplied by said fuel means.

8. The power plant of claim 1, wherein said compression acceleration cylinder comprises a liquid cylinder in fluid communication with a liquid chamber of said accumulator.

9. The power plant of claim 1, wherein said compression acceleration cylinder comprises a gas cylinder in fluid communication with a gas chamber of said accumulator.

10. A fluid pumping system, comprising:

an output cylinder including an output piston;

a combustion cylinder including a combustion piston operatively linked to said output piston;

said output and combustion pistons being capable of a compression stroke and a power stroke; and means for measuring the speed of said combustion piston during said power stroke.

11. The pumping system of claim 10, further comprising means responsive to said means for measuring the speed of said combustion piston for adjusting the length of said power stroke.

12. The pumping system of claim 10, further comprising fuel means for supplying fuel to said combustion cylinder and means responsive to said means for measuring the speed of said combustion piston for adjusting the amount of fuel supplied by said fuel means.

13. The pumping system of claim 10, wherein said means for measuring the speed of said combustion piston comprises a ferromagnetic member mounted for travel with said combustion piston and including a series of projections; and magnetic pickup means for sensing the relative movement of said projections.

14. The pumping system of claim 10, wherein said means for measuring the speed of said combustion piston comprises a reflective target mounted for travel with said combustion piston and a reflected wave speed detector.

15. A fluid pumping system, comprising:

an output cylinder including an output piston;

a combustion cylinder including a combustion piston operatively linked to said output piston;

said linked pistons being capable of an output stroke and a compression stroke;

an accumulator in fluid communication with said output cylinder;

mechanical means for changing the position of said output piston within said output cylinder; and control means responsive to the position of said output piston between each said output stroke and a subsequent compression stroke, and to the pressure of fluid in said accumulator, for operating said mechanical means to position said output piston within said output cylinder to provide a desired stroke length of said combustion piston.

16. A fluid pumping system, comprising:

an output cylinder including an output piston;

a pair of opposed combustion pistons;

cylinder means for confining said opposed combustion pistons for reciprocation along a colinear path;

said output and combustion pistons being capable of a compression stroke and a power stroke; and means for drivingly connecting each of said combustion pistons to said output piston including means for transferring the energy of combustion of each of said combustion pistons during each power stroke substantially uniformly to said output piston over the entire length of said power stroke.

17. The pumping system of claim 16, wherein said cylinder means comprises a single cylinder defining a combustion chamber at the center thereof between said combustion pistons.

18. The pumping system of claim 16, wherein said cylinder means comprises a pair of cylinders, each receiving one of said combustion pistons.

19. The pumping system of claim 16, wherein said means for drivingly connecting said output piston and said combustion pistons comprises a pair of cams each connected to one of said combustion pistons; and a pair of cam followers engaging said cams and connected to one of said output pistons; said cam surfaces each being a slope increasing in steepness with respect to said path as said cam surfaces move past said cam followers during said power stroke.

20. A fluid-driven power plant, comprising:

fluid handling means containing a substantially constant system volume of fluid under pressure, said fluid handling means comprising:

an output cylinder including an output piston capable of a fill stroke and an output stroke;

a balance cylinder in fluid communication with said output cylinder;

means for operating said balance cylinder to deliver fluid to said output cylinder during said fill stroke;

means for operating said output cylinder to deliver fluid therefrom;

an accumulator in fluid communication with said output cylinder, the operating pressure level of said accumulator being higher than the pressure within said balance cylinder;

a fluid-driven motor having a port in fluid communication with said accumulator;

drive valve means between said accumulator and said drive motor for directing fluid to said drive motor;

power level selector means for generating a power level signal in a range from a minimum level to a maximum level, corresponding to a plurality of positions of said power level selector;

performance selector means for varying said maximum level and for varying the magnitude of said signal corresponding to each of said positions of said power level selector; and control means responsive to said power level signal for operating said drive valve means.

21. A power plant comprising:

means for generating output power;

means for varying the level of power generated by said generating means;

power level selector means for generating a power level signal in a range from a minimum level to a maximum level, corresponding to a plurality of positions of said power level selector; performance selector means for varying said maximum level and for varying the magnitude of said signal corresponding to each of said positions of said power level selector; and control means responsive to said power level signal for operating said means for varying the level of power generated by said generating means.

22. A fluid-driven power plant, comprising:

fluid handling means containing a substantially constant system volume of fluid under pressure, said fluid handling means comprising:

an output cylinder including an output piston capable of a fill stroke and an output stroke;

a balance cylinder in fluid communication with said output cylinder;

means for operating said balance cylinder to deliver fluid to said output cylinder during said fill stroke;

an accumulator in fluid communication with said output cylinder, the operating pressure level of said accumulator being higher than the pressure within said balance cylinder;

a fluid-driven motor having a port in fluid communication with said accumulator;

power level selector means for generating a power level signal corresponding to a desired power output of said plant;

means for operating said output cylinder to maintain the pressure in said accumulator at a level sufficient to provide said desired power output; and means for selectively causing said output cylinder to increase the pressure in said accumulator to a maximum level regardless of the level required to provide the power output corresponding to the power level signal.

* * * * *